US005545973A

United States Patent [19]

Johnson

[11] Patent Number: 5,545,973

[45] Date of Patent: Aug. 13, 1996

[54] CURRENT GENERATOR FOR INTEGRATED CIRCUITS AND METHOD OF CONSTRUCTION

[75] Inventor: Douglas R. Johnson, Cedar Rapids, Iowa

[73] Assignee: Texas Instruments Incorporated, Dallas, Tex.

[21] Appl. No.: 223,260

[22] Filed: Apr. 4, 1994

[51] Int. Cl.[6] ..... G05F 3/16

[52] U.S. Cl. ..... 323/315; 327/538

[58] Field of Search ..... 323/312, 315, 323/316, 907; 327/538

[56] References Cited

U.S. PATENT DOCUMENTS 4,563,632 1/1986 Palara et al. ..... 323/316
4,618,816 10/1986 Monticelli ..... 323/316
4,970,452 11/1990 Barbu et al. ..... 323/317
4,975,632 12/1990 James et al. ..... 323/315

*Primary Examiner*—Peter S. Wong
*Assistant Examiner*—Adolf Berhane
*Attorney, Agent, or Firm*—Warren L. Franz; W. James Brady, III.; Richard L. Donaldson

[57] ABSTRACT

A current generator (8) is provided. A voltage delta circuit (15) is operable to generate a voltage difference between a first circuit node (NODE 1) and a second circuit node (NODE 2) and is operable to generate a first current ($I_1$) and a second current ($I_2$). A junction field-effect-transistor (14) is coupled to the first circuit node (NODE 1) and the second circuit node (NODE 2). The junction field-effect-transistor (14) operates in a resistive region to stabilize a temperature characteristic of the first current ($I_1$) and the second current ($I_2$). A current mirror circuit (19) coupled to the voltage delta circuit (15), the current mirror circuit (19) operable to receive the first current ($I_1$) and the second current ($I_2$).

15 Claims, 1 Drawing Sheet

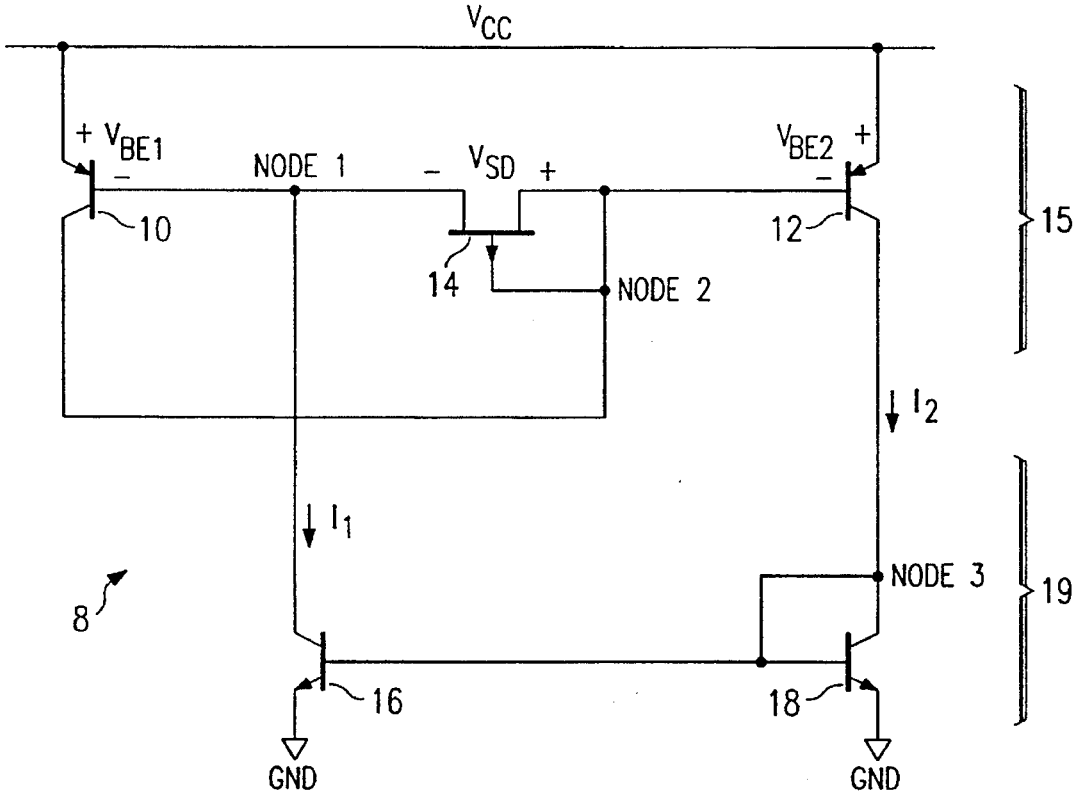
VCC
+ VBE1 −
NODE 1
− VSD +
VBE2 + −
10
12
15
14
NODE 2
I2
I1
NODE 3
19
8
16
18
GND
GND

CURRENT GENERATOR FOR INTEGRATED CIRCUITS AND METHOD OF CONSTRUCTION

TECHNICAL FIELD OF THE INVENTION

This invention relates in general to the field of electronic systems, and more particular to a current generator for integrated circuits,

BACKGROUND OF THE INVENTION

Integrated circuits are widely used in electronic systems. Integrated circuits often are formed on semiconductor substrates and comprise numerous integrated circuit devices. Integrated circuit devices generally are powered by voltage supplies or current sources.

Integrated circuits often include current generators operating as current sources to power devices in the integrated circuit. Such a current generator provides a level of current through a supply node in the current generator. The integrated circuit devices powered by the current generator are arranged to include control nodes connected to the supply node in the current generator to control current supply to the integrated circuit devices. In this manner, current generators are used to provide current supply to subcircuits and devices in the integrated circuit.

It is desirable for a current generator to generate a constant level of current. However, the operation of current generators commonly used in integrated circuits is dependent on operating temperature and on the magnitude of the level of current generated. The level of current generated by a current generator often changes when the operating temperature of the integrated circuit changes. In some integrated circuits, the operating temperatures can range from −55° C. to 125° C. Further, this change as a function of temperature often varies with respect to the magnitude of the level of current generated.

SUMMARY OF THE INVENTION

Therefore, a need has arisen for an improved current generator for integrated circuits that provides reduced temperature dependency.

In accordance with the present invention, an improved current generator for integrated circuits and method of construction is provided that substantially eliminates or reduces disadvantages and problems associated with prior current generators.

According to one embodiment of the present invention, a current generator is provided that includes a voltage delta circuit operable to generate a voltage difference between a first circuit node and a second circuit node and operable to generate a first current and a second current. A junction field effect transistor is coupled to the first circuit node and the second circuit node. The junction field effect transistor operates in a resistive region to stabilize a temperature characteristic of the first current and the second current. A current mirror circuit is coupled to the voltage delta circuit. The current mirror circuit is operable to receive the first current and the second current.

BRIEF DESCRIPTION OF THE DRAWINGS

A more complete understanding of the present invention may be acquired by referring to the following description taken in conjunction with the accompanying drawings in which like reference numbers indicate like features and wherein:

The FIGURE illustrates a current generator constructed according to the teachings of the present invention.

DETAILED DESCRIPTION OF THE INVENTION

The FIGURE illustrates a current generator indicated generally at 8 constructed according to the teachings of the present invention. Current generator 8 comprises a first PNP bipolar transistor 10 and a second PNP bipolar transistor 12. PNP bipolar transistor 10 comprises an emitter coupled to a positive power supply $V_{cc}$. PNP bipolar transistor 10 also comprises a base coupled to a first circuit node NODE 1 and a collector coupled to a second circuit node NODE 2. PNP bipolar transistor 12 comprises an emitter coupled to power supply $V_{cc}$, a base coupled to NODE 2, and a collector coupled to a third circuit node NODE 3.

Current generator 8 further comprises a junction field effect transistor (JFET) 14. JFET 14 comprises a drain coupled to NODE 1, a source coupled to NODE 2 and a gate coupled to NODE 2.

Current generator 8 also comprises a first NPN bipolar transistor 16 and a second NPN bipolar transistor 18. NPN bipolar transistor 16 comprises a collector coupled to NODE 1, a base coupled to NODE 3 and an emitter coupled to circuit ground potential GND. NPN bipolar transistor 18 comprises a collector coupled to NODE 3, a base coupled to NODE 3, and an emitter coupled to circuit ground potential GND.

PNP bipolar transistor 10, PNP bipolar transistor 12 and JFET 14 comprise a $\Delta V_{BE}$ voltage delta circuit indicated generally at 15. NPN bipolar transistor 16 and NPN bipolar transistor 18 comprise a current mirror circuit indicated generally at 19. A first level of current $I_1$ flows through NODE 1 into the collector of NPN bipolar transistor 16. A second level of current $I_2$ flows from the collector of PNP bipolar transistor 12 through NODE 3.

The NPN bipolar transistors 16 and 18 of current generator 8, as shown in the FIGURE, could be replaced with other transistors. In general, a transistor comprises three connections: a control node, a current path input node, and a current path output node. With respect to a NPN bipolar transistor, the control node is the base, the current input node is the collector and the current output node is the emitter. Similarly, with respect to an N-channel metal-oxide-semiconductor field-effect-transistor (MOSFET), the gate is the control node, the drain is the current input node and the source is the current output node. In another embodiment of the present invention, NPN bipolar transistors 16 and 18 are replaced with N-channel MOSFETs.

A technical advantage of a current generator constructed according to the teachings of the present invention is a reduced temperature dependency of the level of current generated and provided by the current generator. Current generator 8 constructed according to the teachings of the present invention comprises a JFET 14 forced to operate in the saturation or resistive region. In this resistive region, the temperature characteristic of the resistance established by JFET 14 is appropriate to cancel the temperature effects of PNP bipolar transistors 10 and 12. Thus, a level of current is generated that is stable over varying temperature.

The current generator 8 illustrated in the FIGURE operates to generate the current $I_1$ and the current $I_2$ that have stable temperature characteristics. The $\Delta V_{BE}$ circuit 15 operates to produce a slightly different $V_{BE}$ voltage $V_{BE1}$ on PNP bipolar transistor 10 and $V_{BE2}$ on PNP bipolar transistor 12. $V_{BE1}$ is slightly larger than $V_{BE2}$. This difference is equal to the voltage $V_{SD}$ across the source and drain of the JFET 14.

Current generator 8 operates in a feedback loop to generate one of two stable levels of current. One stable state for current generator 8 occurs when no current is flowing, and both $I_1$ and $I_2$ are equal to zero. The second stable state for current generator 8 occurs when the magnitudes of $I_1$ and $I_2$ reach an equilibrium level. The feedback in current generator 8 is provided by the connections of the collector of PNP bipolar transistor 10 to the base of PNP bipolar transistor 12 and of the collector of NPN bipolar transistor 16 to the base of PNP bipolar transistor 10. The feedback also is established by the connection of the base of NPN bipolar transistor 16 to the collector of NPN bipolar transistor 18. When current is flowing, current generator 8 operates to produce levels of current $I_1$ and $I_2$ that are maintained by this feedback.

The ratio of the magnitude of the level of current $I_1$ to the magnitude of the level of current $I_2$ is determined by the ratio of the size of NPN bipolar transistor 16 to the size of NPN bipolar transistor 18. For example, if NPN bipolar transistor 16 is five times the size of NPN bipolar transistor 18, the current level $I_1$ is five times the current level $I_2$, assuming negligible base currents. The current mirror circuit 19 operates such that the current level $I_1$ flowing through NPN bipolar transistor 16 mirrors the current level $I_2$ flowing through NPN bipolar transistor 18. The level of current generated by current generator 8 can be modified by changing the geometries of the transistors: the ratio of PNP bipolar transistors 10 and 12, the ratio of NPN bipolar transistors 16 and 18, and the ratio of the width to the length of the channel of JFET 14.

JFET 14 is connected such that it operates in the saturation or resistive region. In this region, the resistance established by JFET 14 varies with respect to temperature. This temperature variation tends to cancel the temperature characteristics of PNP bipolar transistor 10 and PNP bipolar transistor 12. In this way, current generator 8 generates temperature stable levels of current $I_1$ and $I_2$.

Current generator 8 operates as a current source for integrated circuit devices in an integrated curcuit. The level of current $I_2$ flowing through NODE 3 operates to control current supply to other devices. Other integrated circuit devices are arranged to have control nodes coupled to the supply node NODE 3. In one embodiment, an NPN bipolar transistor with its emitter coupled to ground potential has its base coupled to NODE 3. The collector to emitter current then is an amplification of the base current drawn from NODE 3. In such manner, current generator 8 can control current supply to other devices in an integrated circuit.

The temperature stable characteristic of current generator 8 can be shown by mathematically analyzing the currents generated by the devices of current generator 8. The current flowing through JFET 14 is $I_{SD}$ and is approximately equal to the level of current $I_1$ assuming negligible base and gate currents. The temperature characteristics of $I_{SD}$ defines the temperature characteristics of the levels of current generated by current generator 8.

The following analysis arrives at a solution for the level of current $I_{SD}$ in current generator 8 as a function of temperature. The sum of the voltage levels in a loop are equal to zero. Thus, $$V_{EB1}-V_{BE2}-V_{SD}=0$$

$$V_{SD}=V_{EB1}-V_{BE2}$$

Formulas can be substituted for $V_{EB1}$ and $V_{EB2}$ of PNP bipolar transistors 10 and 12.

$$V_{SD}=V_T\ln\left(\frac{I_{C1}}{A_1I_{S1}}\right)-V_T\ln\left(\frac{I_{C2}}{A_2I_{S2}}\right)$$

$$V_{SD}=V_T\ln\left(\frac{I_{C1}}{I_{C2}}\cdot\frac{A_2}{A_1}\cdot\frac{I_{S2}}{I_{S1}}\right)$$

where, $V_T$ is the threshold voltages;

$I_{C1}$ and $I_{C2}$ are collector currents;

$I_{S1}$ and $I_{S2}$ are saturation currents;

$A_1$ and $A_2$ are the physical areas of PNP bipolar transistors 10 and 12, respectively.

$I_{C1}$ and $I_{C2}$ are proportional to the physical areas $A_3$ and $A_4$ of NPN bipolar transistors 16 and 18, respectively. Assume PNP bipolar transistors 10 and 12 have $I_{S1}$ equal to $I_{S2}$.

$$\text{If } A_3=A_4, \text{ then } V_{SD}=V_T\ln\left(\frac{A_2}{A_1}\right)$$

$$\text{If } A_3\neq A_4, \text{ then } V_{SD}=V_T\ln\left(\frac{A_3}{A_4}\cdot\frac{A_2}{A_1}\right)$$

Because the voltage level $V_{SD}$ across JFET 14 is the difference between $V_{BE1}$ and $V_{BE2}$ which is small, JFET 14 operates in its saturation or resistive region.

The equation for $I_{SD}$ of JFET 14 in the saturation region is $$I_{SD}=-\beta\frac{W}{L}\ (2(V_{gs}+V_p)V_{SD}+V_{SD}^2)$$

Assume the pinch-off voltage $V_p$ of JFET 14 is less than zero volts, and $V_{SD}$ is small enough such that $V_{SD}^2$ is negligible. Further, the gate-to-source voltage level $V_{gs}$ for JFET 14 is zero because the gate and source are connected together. Therefore:

$$I_{SD}\approx-\beta\frac{W}{L}\ 2V_pV_{SD}$$

$$V_{SD}=\frac{-I_{SD}}{\beta\frac{W}{L}\ 2V_p}$$

where, $\beta$ is a physical constant describing characteristics of the material from which JFET 14 is constructed;

W/L represents the ratio of the width W to the length L of the channel in JFET 14.

Substituting for $V_{SD}$, the following equation results.

$$\frac{-I_{SD}}{2\beta\frac{W}{L}\ V_p}=V_T\ln\left(\frac{A_2}{A_1}\right)$$

$$I_{SD}=-2\beta\frac{W}{L}\ V_pV_T\ln\left(\frac{A_2}{A_1}\right)$$

It is desired to represent $I_{SD}$ as a function of temperature. The variables in the above equation written as functions of temperature have the following equations.

$$\beta(T)=B_O1.01^{T_{C\beta}(T-T_O)}$$

$$V_p(T)=V_{PO}+T_{CV_P}(T-T_O)$$

$$V_T(T)=\frac{KT}{q}$$

where, $T_O$ is room temperature approximately equal to 25° C. or 300° K., $T_{C\beta}$ is an empirical constant derived for and exponential approximation of data describing physical characteristics of JFET 14, and $T_{CV_P}$ is an empirical constant derived for a linear approximation of data describing physical characteristics of JFET 14.

The values of $T_{C\beta}$ and $T_{CV_P}$ can be derived from the following equations, although other equations can be utilized.

$$T_{C\beta}=\frac{\ln\frac{\beta(T_1)}{\beta(T_2)}}{(T_1-T_2)\ln(1.01)}$$

$$T_{CV_P}=\frac{V_P(T_1)-V_P(T_2)}{T_1-T_2}$$

where, $T_1$ is a first measured temperature, and $T_2$ is a second measured temperature.

Thus, stating $I_{SD}$ as a function of temperature:

$$I_{SD}(T)=-2\beta(T)\frac{W}{L}\ln\left(\frac{A_2}{A_1}\right)V_P(T)V_T(T)$$

If current generator 8 is stable with respect to temperature, then the following is true within the operating temperature range of current generator 8.

$$\frac{\delta I(T)}{\delta T}=0$$

$$0=-2\frac{W}{L}\ln\left(\frac{A_2}{A_1}\right)V_P(T)\beta(T)V_T(T)\cdot\left[\frac{1}{V_T(T)}\cdot\frac{\delta V_T(T)}{\delta T}+\frac{1}{\beta(T)}\cdot\frac{\delta\beta(T)}{\delta T}+\frac{1}{V_P(T)}\frac{\delta V_P(T)}{\delta T}\right]$$

If $\ln\left(\frac{A_2}{A_1}\right)\neq 0$, $V_P(T)\neq 0$, $\beta(T)\neq 0$ and $V_T(T)\neq 0$, then $$0=\frac{1}{V_T(T)}\cdot\frac{\delta V_T(T)}{\delta T}+\frac{1}{\beta(T)}\cdot\frac{\delta\beta(T)}{\delta T}+\frac{1}{V_P(T)}\cdot\frac{\delta V_P(T)}{\delta T}$$

From the above equations defining these functions, the following are true.

$$\frac{1}{V_T(T)}\cdot\frac{\delta V_T(T)}{\delta T}=\frac{1}{T}$$

$$\frac{1}{\beta(T)}\cdot\frac{\delta\beta(T)}{\delta T}=\ln(1.01)T_{C\beta}$$

$$\frac{1}{V_P(T)}\cdot\frac{\delta V_P(T)}{\delta T}=\frac{T_{CV_P}}{V_{po}+T_{CV_P}(T-T_o)}$$

Substituting these values, $$0=\frac{1}{T}+\ln(1.01)T_{C\beta}+\frac{T_{CV_P}}{V_{po}+T_{CV_P}(T-T_0)}$$

The magnitude of $T_{CV_P}(T-T_O)$ is much less than $V_{po}$, and is negligible. Therefore, $$0=\frac{1}{T}+\ln(1.01)T_{C\beta}+\frac{T_{CV_P}}{V_{po}}$$

$$T_A=\left(-\ln(1.01)T_{C\beta}-\frac{T_{CV_P}}{V_{po}}\right)^{-1}$$

The value $T_A$ represents the temperature at which zero slope occurs on the function describing the level of current $I_{SD}$ as a function of temperature. As can be seen from the above equation, $T_A$ is defined only by process parameters $T_{C\beta}$, $T_{CV_P}$ and $V_{po}$.

In one embodiment of the present invention, JFET 14 is formed on a silicon substrate along with the other devices in current generator 8. For this embodiment, the operating temperature of the integrated circuit varies from −55° C. to 125° C. In this embodiment, the values for the process parameters in the $T_A$ equation are:

$$\beta_0=7.9\times10^{-6}\frac{\mu A}{\text{volts}^2}$$

$$V_{po}=-1.59\text{ volts}$$

$$T_{C\beta}=-0.42\ C^{-1}$$

$$T_{CV_P}=-0.00136\frac{\text{volts}}{C}$$

Substituting these values into the $T_A$ equation, $T_A$=300.47° K. or $T_A\approx$25° C.

Thus, the function describing the level of current $I_{SD}$ as a function of temperature has a zero slope point at 25° C. This is a local maximum and occurs near the middle of the operating range of −55° C. to 125° C. The curve is relatively flat and thus temperature stable in this range. Further, the curve is not dependent upon the geometries of the transistors in current generator 8. The curve is dependent only on process parameters of the process used to form JFET 14 in current generator 8.

According to the teachings of the present invention, the level of current generated by a current generator is temperature stable near the center of the operating range of the integrated circuit. In one embodiment of the present invention, the operating range of the integrated circuit is between −55° C. and 125° C., and a current generator constructed according to the teachings of the present invention provides a temperature stable level of current near 25° C. Further, this temperature stability is independent of the geometries of the transistors in the current generator. Integrated circuit process parameters define the zero slope point of the generated level of current as a function of temperature. Thus, a circuit designer can choose from a large range of levels of generated current while keeping constant the temperature dependence of the current generation.

A technical advantage of a current generator constructed according to the teachings of the present invention is a temperature characteristic determined only by integrated circuit process parameters. A circuit designer can change the magnitude of the level of current generated and provided by the current generator without changing the temperature characteristics. The percentage change with respect to temperature is dependent only on the integrated circuit process parameters. Further, a current generator constructed according to the teachings of the present invention does not require abnormally large JFETs to produce small levels of current.

A further technical advantage of the present invention is an ability to fabricate a current generator according to the teachings of the present invention using existing processes. Most bipolar processes, and some MOS processes, comprise process flows that could be adapted to fabricate a JFET according to the teachings of the present invention. Consequently, a large number of integrated circuits may benefit from the teachings of the present invention. Examples of integrated circuits that might benefit from the teachings of the present invention are operational amplifiers, comparators, data converters, voltage regulators and voltage references. A current generator constructed according to the teachings of the present invention can be incorporated into any of these integrated circuits giving a technical advantage in temperature performance.

Although the present invention has been described in detail, it should be understood that various changes, substitutions and alterations can be made hereto without departing from the spirit and scope of the invention as defined by the appended claims.

What is claimed is:

1. A current generator for an integrated circuit, comprising:

a first transistor having a first current path node, a second current path node, and a control node;

a second transistor having a first current path node, a second current path node, and a control node connected to said first transistor second current path node;

a junction field-effect transistor having a first current path node connected to said first transistor control node, a second current path node connected to said second transistor control node, and a control node connected to one of said field-effect transistor first and second current path nodes;

a current mirror circuit having first and second mirroring current paths, said first current path connected to said first transistor control node, and said second current path connected to said second transistor second current path node.

2. A current generator for an integrated circuit, comprising: first and second voltage nodes;

a first transistor having a first current path node connected to said first voltage node, a second current path node, and a control node;

a second transistor having a first current path node connected to said first voltage node, a second current path node, and a control node connected to said first transistor second current path node;

a junction field-effect transistor having a first current path node connected to said first transistor control node, a second current path node connected to said second transistor control node, and a control node connected to one of said field-effect transistor first and second current path nodes;

a current mirror circuit having first and second mirroring current paths, said first current path connected between said first transistor control node and said second voltage node, and said second current path connected between said second transistor second current path node and said second voltage node.

3. The current generator of claim 2, wherein said first and second transistors are bipolar transistors.

4. The current generator of claim 3, wherein said first and second transistors are each a PNP transistor with its first current path node being an emitter, its second current path node being a collector, and its control node being a base; said first voltage node is connected to a positive voltage source; and said second voltage node is connected to ground.

5. The current generator of claim 2, wherein said current mirror circuit comprises a third transistor having a first current path node connected to said first transistor control node, a second current path node connected to said second voltage node, and a control node; and a fourth transistor having a first current path node connected to said second transistor second current path node, a second current path node connected to said second voltage node, and a control node connected to said third transistor control node; one of said third and fourth transistors having its first current path node connected to its control node.

6. The current generator of claim 5, wherein said third and fourth transistors are bipolar transistors.

7. The current generator of claim 6, wherein said third and fourth transistors are each an NPN transistor with its first current path node being a collector, its second current path node being an emitter, and its control node being a base.

8. The current generator of claim 7, wherein said fourth transistor has its collector connected to its base.

9. The current generator circuit of claim 2, wherein said field-effect transistor is an MOS field-effect transistor having a source connected to said second transistor control node, a gate connected to said source, and a drain connected to said first transistor control node.

10. A current generator for an integrated circuit, comprising: first and second voltage nodes;

a first bipolar transistor having one of an emitter and a collector connected to said first voltage node, and a base;

a second bipolar transistor having one of an emitter and a collector connected to said first voltage node, and a base connected to the other of said first transistor emitter and collector;

a junction field-effect transistor having one of a source and a drain connected to said first transistor base, the other of said source and drain connected to said second transistor base, and a gate connected to bias said field-effect transistor into saturation; and a current mirror circuit having first and second mirroring current paths, said first current path connected between said first transistor base and said second voltage node, and said second current path connected between said second transistor other of said emitter and collector and said second voltage node.

11. The current generator of claim 10, wherein said current mirror comprises a third transistor having a first current path node connected to said first transistor one of said emitter and collector, a second current path node connected to said second voltage node, and a control node; and a fourth transistor having a first current path node connected to said second transistor one of said emitter and collector, a second current path node connected to said second voltage node, and a control node connected to said third transistor control node; one of said third and fourth transistors having its first current path node connected to its control node.

12. The current generator of claim 11, wherein said third and fourth transistors are bipolar transistors; said third transistor has one of an emitter and a collector connected to said first transistor base, the other of said third transistor emitter and collector connected to said second voltage node, and a base; and said fourth transistor has one of an emitter and a collector connected to said second transistor other of said emitter and collector, said other of said fourth transistor emitter and collector connected to said second voltage node, and a base connected to said third transistor base; one of said third and fourth transistors having its said one of said emitter and collector connected to its base.

13. A current generator circuit, comprising:

first, second, third, fourth and junction field-effect transistors, each having two current path nodes and a control node;

said first transistor, junction field-effect transistor, and second transistor current path nodes being connected in series to define a first current flow path; and said third transistor and fourth transistor being connected in series to define a second current path;

said first transistor control node being connected to one of said field-effect transistor current path nodes, and said third transistor control node being connected to the other of said field-effect transistor current path nodes; and said second and fourth transistor control nodes being commonly connected for mirroring current flowing in said first and second current flow paths.

14. A method of generating current in an integrated circuit, comprising:

flowing current in a first current path comprising a series connection of current flow nodes of a first transistor and a junction field-effect transistor;

flowing current in a second current path comprising current flow nodes of a second transistor;

controlling current flow through said first transistor by connection of one of said field-effect transistor current path nodes to a control node of said first transistor;

controlling current flow through said third transistor by connection of the other of said field-effect transistor current path nodes to a control node of said second transistor; and mirroring current flowing in said first and second current paths.

15. A method of generating current in an integrated circuit, comprising:

flowing current in a first current path comprising a series connection of current flow nodes of a first transistor; a junction field-effect transistor, and a second transistor;

flowing current in a second current path comprising a series connection of current flow nodes of a third transistor and fourth transistor;

controlling current flow through said first transistor by connection of one of said field-effect transistor current path nodes to a control node of said first transistor;

controlling current flow through said third transistor by connection of the other of said field-effect transistor current path nodes to a control node of said third transistor; and mirroring current flow through said second and fourth transistors by common connection of control nodes of said second and fourth transistors.

* * * * *